US009352894B2

(12) United States Patent
Brzon et al.

(10) Patent No.: US 9,352,894 B2
(45) Date of Patent: May 31, 2016

(54) PORTABLE CLECO TYPE FASTENER DISPENSER

(71) Applicant: The Boeing Company, Chicago, IL (US)

(72) Inventors: Mark Brzon, Wichita, KS (US); Brian Louis Trimmell, Wichita, KS (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 14/580,706

(22) Filed: Dec. 23, 2014

(65) Prior Publication Data

US 2015/0108155 A1 Apr. 23, 2015

Related U.S. Application Data

(62) Division of application No. 13/424,815, filed on Mar. 20, 2012, now Pat. No. 8,955,714.

(51) Int. Cl.

| | |
|---|---|
| ***B65H 1/08*** | (2006.01) |
| ***G07F 11/16*** | (2006.01) |
| ***B65D 83/02*** | (2006.01) |
| ***B21J 15/14*** | (2006.01) |
| *B25B 31/00* | (2006.01) |

(52) U.S. Cl.

CPC ..... *B65D 83/02* (2013.01); *B21J 15/142* (2013.01); *B25B 31/005* (2013.01)

(58) Field of Classification Search

CPC ..... B65H 1/30; B65H 1/00
USPC ..... 221/221, 155, 181, 307, 279, 281
See application file for complete search history.

(56) References Cited

U.S. PATENT DOCUMENTS

| | | | | |
|---|---|---|---|---|
| 2,073,328 | A * | 3/1937 | Wasserlein, Sr. | A63B 57/0031 206/315.1 |
| 2,078,328 | A * | 4/1937 | Kraft | E05C 17/28 296/96.2 |
| 2,857,794 | A * | 10/1958 | Red, Jr. | B25B 23/065 221/307 |
| 2,885,110 | A * | 5/1959 | Tregilgas | B65D 83/0409 221/185 |
| 2,893,599 | A * | 7/1959 | Kay | B65D 83/0409 221/197 |
| 2,901,146 | A * | 8/1959 | Powell, Jr. | A63B 57/0031 221/190 |
| 3,300,090 | A * | 1/1967 | Carden | B65D 83/0409 221/281 |
| 3,365,099 | A * | 1/1968 | McTaggart | A61J 7/04 206/459.1 |
| 3,412,897 | A * | 11/1968 | Slater | A63B 47/00 221/226 |

(Continued)

*Primary Examiner* — Rakesh Kumar

(74) *Attorney, Agent, or Firm* — Joseph M. Rolnicki; Evans & Dixon, L.L.C.

(57) ABSTRACT

An apparatus for containing, transporting, dispensing and keeping an inventory of a plurality of same size cleco type fasteners has a tubular housing with an interior bore dimensioned to receive the plurality of cleco type fasteners through a proximal opening on the housing that is closed by a removable closure device. The distal end of the housing has a retention device that retains the forward most cleco type fastener inserted into the housing interior bore with a sufficient force that prevents the forward most cleco type fastener from being unintentionally removed from the housing distal end, but allows the forward most cleco type fastener to be manually grasped and pulled from the housing distal end.

19 Claims, 3 Drawing Sheets

(56) References Cited

U.S. PATENT DOCUMENTS 3,436,163 A 4/1969 Gang et al.
3,612,349 A * 10/1971 Thomas ..... B65D 83/0409 221/232
3,729,421 A * 4/1973 Gibson ..... A47K 5/09 221/307
3,768,636 A * 10/1973 O'Connell, Jr. ..... B65D 51/26 206/535
3,840,149 A 10/1974 Zeller
3,854,625 A * 12/1974 Kuebler ..... B65D 83/0409 221/198
3,877,473 A * 4/1975 Williams ..... A63F 11/0002 221/297
3,892,334 A * 7/1975 Hand, II ..... A63B 57/0031 221/281
3,998,238 A * 12/1976 Nigro ..... G07D 9/002 221/279
4,113,143 A * 9/1978 Spagnola, Jr. ..... A63F 11/0002 221/267
4,119,243 A * 10/1978 Marecek ..... B65G 47/8815 221/296
4,174,048 A * 11/1979 Volpe, Jr. ..... B65D 83/0409 206/537
4,346,804 A * 8/1982 Powderly ..... B21J 15/34 206/206
4,600,118 A * 7/1986 Martin ..... B65G 47/06 221/1
4,637,403 A * 1/1987 Garcia ..... A61B 5/1411 600/368
4,858,784 A * 8/1989 Moody ..... A63B 57/0031 221/155
4,984,709 A * 1/1991 Weinstein ..... B65D 83/0409 206/536
5,219,198 A * 6/1993 Davis ..... B25B 23/10 221/280
5,505,510 A * 4/1996 Duncan ..... A63B 47/02 294/19.2
5,736,103 A * 4/1998 Pugh ..... B01L 3/5023 422/401
7,273,158 B1 * 9/2007 Dean ..... A63B 47/002 221/245
7,604,124 B1 * 10/2009 Shingle ..... A61J 1/03 206/534
8,308,026 B2 * 11/2012 Rapko ..... B25B 9/00 206/37
2009/0126321 A1 * 5/2009 Martin ..... A47F 1/10 53/473
2011/0272426 A1 * 11/2011 Ortenzi ..... A61J 7/0076 221/2
2015/0108155 A1 * 4/2015 Brzon ..... B21J 15/142 221/1

* cited by examiner

PORTABLE CLECO TYPE FASTENER DISPENSER

This is a divisional patent application from patent application Ser. No. 13/424,815, which was filed on Mar. 20, 2012 and is currently pending.

FIELD

The present invention pertains to an apparatus for containing, transporting and dispensing a plurality of cleco type fasteners and also for keeping an inventory of the fasteners in use.

BACKGROUND

In the aerospace manufacturing and repair industries there is a need to keep strict controls over fasteners, tools and other similar objects that are used in manufacturing and repair of aircraft, spacecraft, etc., but do not become a structural part of the craft being manufactured or repaired. Care must be taken that these objects are removed from the craft after use. Foreign objects left behind inside an aircraft or spacecraft have the potential for causing significant damage to that craft during flight. This type of damage has become so important in the aerospace manufacturing and repair industries that it has been given the particular designation of Foreign Object Damage ("FOD").

(Foreign Object Damage) has become a major safety focus of the Federal Aviation Administration (FAA). Federal regulations have been drafted and industrial procedures have been developed to control and curb the potential for FOD in the aircraft manufacturing and repair industries.

FOD control becomes particularly difficult when dealing with smaller objects and when dealing with a large number of objects that are used in aircraft manufacturing and repair. This is particularly true for the conventional cleco type fastener.

Conventional cleco type fasteners are available in five different sizes that are all relatively small. This contributes to the possibility of a cleco type fastener used in a manufacturing or repair procedure to be overlooked and left behind when that procedure is completed.

Additionally, the conventional cleco type fastener is often used in large numbers in manufacturing and repair procedures. With a large number of such fasteners used in a manufacturing or repair procedure, the probability of one or two such fasteners being left behind when the procedure is completed increases.

The current best practice for monitoring or keeping inventory of cleco type fasteners in use during a manufacturing or repair procedure is to keep the fasteners in a zippered bag or some other type of container prior to their use, and returning the fasteners to the bag or container after their use. However, this practice is not very efficient. The bag or container is often used to hold other items such as tools or personal items. These other items kept in the same bag or container with the fasteners can interfere with viewing the fasteners for quantity accountability on and off an aircraft. This can lead to incorrect counts of the fasteners in the bag or container which could result in a fastener being left behind in the structure of the aircraft after the manufacturing or repair procedure.

Furthermore, the use of a bag or container for keeping an inventory of cleco type fasteners requires that the bag or container be opened during use. This presents the potential problem of the bag or container being knocked over in the aircraft interior causing fasteners contained in the bag or container to spill out and fall through the structure of the aircraft. Retrieving spilled fasteners from the interior structure of the aircraft would be difficult and time consuming.

Still further, often pluralities of different size cleco type fasteners are kept in the bag or container. This makes it difficult to quickly retrieve and account for the particular size fastener needed for a particular manufacturing or repair procedure. This leads to manufacturing and repair inefficiencies.

There is a need to overcome the disadvantages associated with the traditional methods of containing, transporting and keeping inventory of cleco type fasteners used in aircraft manufacturing and repair industries, as well as other similar industries.

SUMMARY

The present invention is an apparatus that is used in containing, transporting and dispensing a plurality of a same size of cleco type fasteners that enhances aircraft manufacturing and repair FOD programs while also improving manufacturing efficiencies.

The apparatus has an elongate tubular housing with opposite proximal and distal ends. An interior bore extends through the housing and a cylindrical interior surface surrounds the interior bore. The interior surface has an interior diameter dimension that is just slightly larger than the outer diameter dimension of the plurality of same size cleco type fasteners that are to be used with the apparatus. The proximal end of the housing has an opening to the interior bore. The distal end of the housing also has an opening to the interior bore.

A closure device, for example a screw threaded cap is removeably attached to the housing proximal end. The cap is removed from the housing to allow a plurality of the cleco type fasteners to be inserted end to end in the housing bore, and then is reattached to the housing to prevent the fasteners from spilling from the housing proximal end.

A retention device is provided at the housing distal end. The retention device extends into the housing interior bore and engages with a forward most cleco type fastener in the housing interior bore. The retention device retains the engaged cleco type fastener in the interior bore with a portion of the cleco type fastener protruding from the housing distal end.

In use, the closure device is removed from the housing proximal end and a plurality of same size cleco type fasteners are inserted into the housing interior bore. The fasteners are inserted in the same orientations with the fasteners plunger heads inserted first into the interior bore. The fasteners slide through the interior bore until the forward most fastener engages with the retention device and is retained in the housing interior bore. The plunger head of the retained forward most fastener protrudes from the housing distal end where it can be easily manually grasped and pulled from the housing distal end. The retention device retains the forward most fastener with a sufficient force to resist the combined weight of the fasteners filling the housing interior bore from pushing the retained forward most fastener through the retention device and out of the housing distal end opening. With the housing interior bore filled with cleco type fasteners arranged end to end, the closure device is attached to the housing proximal end to prevent the fasteners from exiting the housing at the housing proximal end.

With the housing so filled with the plurality of cleco type fasteners, the forward most fastener is retained by the retention device with the plunger head of the forward most fastener protruding from the housing distal end. The protruding plunger head of the fastener can be manually grasped and pulled from the retention device and separated from the housing distal end by a slight pulling force when needed for use. Positioning the housing with the housing proximal end slightly above the housing distal end will cause the remaining fasteners to slide through the interior bore until the next in line fastener is retained by the retention device with the plunger head of the next in line fastener protruding from the housing distal end where it is available for use.

The apparatus provides for the secure containing, transporting and dispensing of a plurality of same size cleco type fasteners and overcomes the inventory and FOD control problems of prior apparatus and methods used for containing, transporting and using cleco type fasteners.

The features, functions and advantages that have been discussed can be achieved independently in various embodiments or may be combined in yet other embodiments, further details of which can be seen with reference to the following description and drawings.

DESCRIPTION

The present invention is an apparatus for containing, transporting, dispensing and keeping inventory of a plurality of same size of cleco type fasteners. The apparatus and its method of use enhance aircraft manufacturing and repair FOD programs while also improving manufacturing efficiencies.

Figure 1:
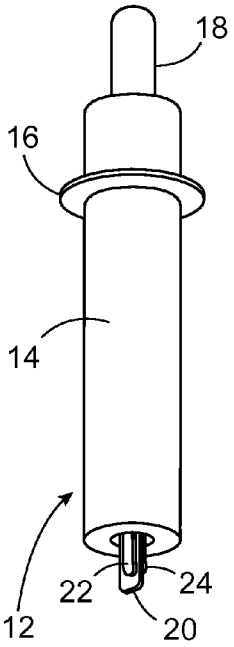
FIG. 1 is an elevation view of a conventional cleco type fastener.
Figure 4:
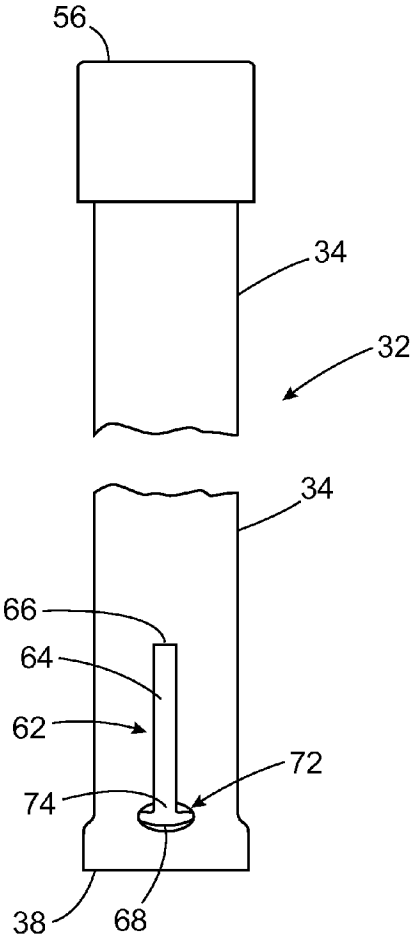
FIG. 4 is an elevation view similar to that of FIG. 3, but with the apparatus rotated 90 degrees.

Cleco type fasteners are known and will not be described in detail herein. The typical construction of a cleco type fastener 12 is shown in FIG. 1. The cleco type fastener 12 is a temporary fastener that is often used to hold two or more parts together prior to assembling the parts together with rivets. For this description, the cleco type fastener actually functions as a temporary rivet. Conventional cleco type fasteners 12 come in four different sizes. The four different size fasteners fit into rivet holes of 3/32", 1/8", 5/32", 3/16" and 1/4". A rivet hole is drilled through the parts and the cleco fastener is installed in the hole to hold the parts together. Additional holes for additional rivets can then be drilled while the cleco fastener holds the parts together. When rivets are installed in the additional holes, the cleco fastener can then be removed and a rivet installed in its hole.

The representation of the cleco type fastener 12 shown in FIG. 1 has a cylindrical housing 14 with an annular flange 16 extending around the housing. A plunger 18 projects from one end of the housing. A spacer 20 and a pair of locking pins 22, 24 project from the opposite end of the housing. A spring is contained inside the housing. The fastener 12 is used with a special set of pliers that grip the fastener 12 between the flange 16 and the plunger 18. Manually squeezing the pliers depresses the plunger 18 into the housing 14 and causes the locking pins 22, 24 to extend from the housing 14 and beyond the spacer 20. As the pins 22, 24 are extended beyond the spacer 20 they come together at their distal ends. The pins can then be inserted into a rivet hole. As the force of the pliers on the plunger 18 is released, the locking pins 22, 24 retract back into the housing 14 and are separated from each other by the spacer 20. As the distal ends of the pins 22, 24 separate they engage and lock against the opposite sides of the rivet hole. The spring in the plunger housing 14 pulls the locking pins 22, 24 toward the housing 14, pulling the two parts tightly together between the distal ends of the locking pins 22, 24 and the housing 14. In this way, the cleco type fastener 12 functions as a temporary rivet.

As stated earlier, the apparatus 32 of the invention contains, transports, dispenses and keeps inventory of a plurality of same size cleco type fasteners such as that shown in FIG. 1.

The apparatus 32 has a straight, elongate tubular housing 34 having opposite proximal 36 and distal 38 ends. The housing 34 is constructed of a plastic material or some other equivalent type of material. The housing 34 has a cylindrical interior surface 42 that defines a hollow interior bore. The interior bore extends through the housing length from a circular proximal end opening at the housing proximal end 36 to a circular distal end opening at the housing distal end 38. The interior surface 42 has an interior diameter dimension that is just slightly larger than the exterior diameter dimension of the flange 16 of the cleco fastener to be used in the apparatus 32. This allows a plurality of the same size of cleco fasteners to slide through the housing interior bore arranged end to end and in a same orientation. The interior diameter dimension of the cylindrical interior surface 42 keeps the plurality of fasteners 12 in their aligned arrangement. The housing 34 could be constructed of a transparent material enabling the plurality of fasteners contained in the housing to be viewed from the housing exterior. Alternatively, the housing could be constructed with a slot 46 that extends along at least a portion of the length of the housing 34 and enables the number of fasteners 12 contained in the housing to be viewed from the housing exterior. Markings 48 could be provided on the exterior of the housing 34 providing a visual indication of the number of fasteners contained in the housing. The positions of the markings 48 along the housing length from the housing distal end 38 would correspond with positions of fasteners 12 arranged end to end in the housing. A size indicator 52 could also be provided on the exterior of the housing 34 providing a visual indication of the size of the cleco type fasteners 12 contained in the housing. The size indicator 52 could be a color marking on the housing or some other equivalent indicator of the size of the fasteners contained in the housing.

The apparatus also includes a closure device 56 that is removeably attachable to the housing proximal end 36. The closure device 56 closes the interior bore proximal opening and prevents the plurality of cleco type fasteners 12 inserted into the housing interior bore from spilling from the interior bore. The closure device 56 is also manually removeable from the housing proximal end 36 to open the interior bore proximal opening and allow for cleco type fasteners 12 to be inserted into the housing interior bore. The closure device 56 represented in the drawing figures is a cap that is screw threaded over the housing proximal end 36. Other equivalent types of closure devices could be used in place of the cap.

The apparatus 32 is also provided with a retention device 62 adjacent the housing distal end 38. In the representation of the apparatus shown in the drawing figures, the retention device 62 is comprised of a pair of elongated strips 64 of spring steel having opposite proximal 66 and distal 68 ends.

In other embodiments of the apparatus, only one of the retention devices 62 may be used. Additionally, the retention device strips could be formed integrally with the housing. The strips proximal ends 66 are secured to the exterior of the housing 34 on opposite sides of the housing with the lengths of the strips 64 extending along the housing length. Holes 72 are providing through opposite sides of the housing 34 adjacent the strip distal ends 68. The strip distal ends 68 are formed as projections that extend through the adjacent holes 72 and into the housing interior bore. As represented in the drawing figures, the projections 74 on the strip distal ends 68 extend through the holes 72 and into the housing interior bore a sufficient distance to engage against a cleco fastener housing 14 and flange 16. In this manner the retention device retains the cleco fastener in the housing interior bore with a portion of the fastener passing through the bore distal end opening to an exterior of the housing. The lengths of the retention device strips 64 are sufficiently resilient so that, with the strip proximal ends 66 connected to the exterior of the housing 34, the remaining lengths of the strips 64 and the distal end 74 projections can deflect outwardly away from each other to allow the cleco fastener flange to pass between the projections 74. When the cleco fastener 12 has moved out of engagement with the projections 74 the resiliency of the strips 64 then causes the projections 74 to return to their at rest positions in the housing interior bore.

In use of the apparatus 32, the closure device or cap 56 is first manually screw threaded off of the housing proximal end 36 exposing the internal bore opening at the housing proximal end. A plurality of cleco type fasteners 12 are then inserted through the internal bore opening at the housing proximal end 36 with their plungers 18 inserted first. The plurality of fasteners are inserted into the housing interior bore with the fasteners all having the same size and the same orientation. The fasteners 12 are aligned end to end in the housing interior bore with the forward most fastener 78 in the line being retained in the interior bore by the retention device 62. As represented in the drawing figures, the forward most fastener 78 is retained in the housing interior bore with the plunger head 82 of the fastener protruding from the housing distal end 38. The projections 74 at the retention device distal ends 68 engage against the housing and flange of the forward most fastener 78 with a sufficient force to prevent the combined weight of the plurality of fasteners 12 in the housing interior bore from pushing the forward most fastener 78 past the retention device projections 74 and out of the housing 34. With the housing interior bore filled with cleco type fasteners, the closure device 56 is reattached to the housing proximal end 36 to prevent the fasteners from exiting the housing at the housing proximal end.

When needed for use, the protruding plunger head 82 of the forward most fastener 78 can be manually grasped and the fastener pulled from the retention device 62 and separated from the housing distal end 38 by a slight pulling force. Positioning the housing with the housing proximal end 36 slightly above the housing distal end 38 will cause the remaining cleco type fasteners in the housing interior bore to slide through the interior bore. The next in line cleco type fastener will move into the retention device 62 and be retained in the interior bore with the plunger head of the next in line fastener protruding from the housing distal end 38 where it is available for use.

Figure 3:
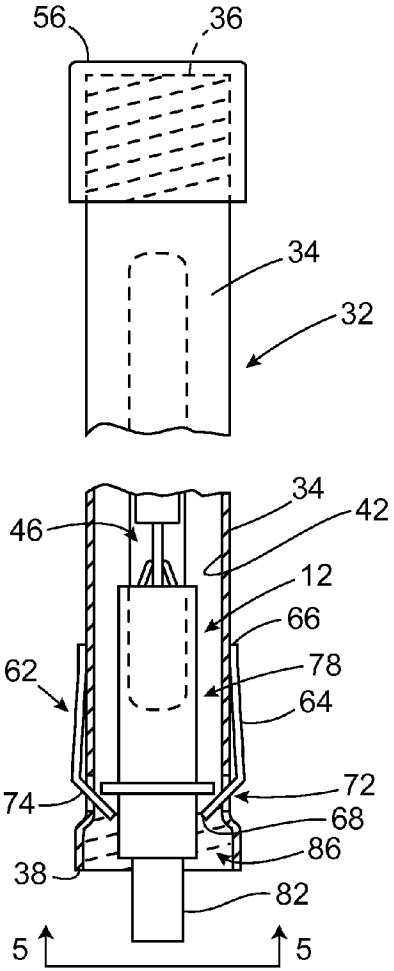
FIG. 3 is an elevation view, partially in section of the apparatus.
Figure 5:
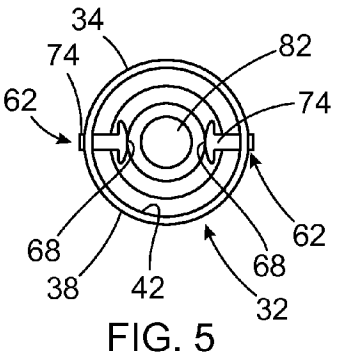
FIG. 5 is a plan view of the apparatus distal end from the line 5-5 shown in FIG. 3.
Figure 2:
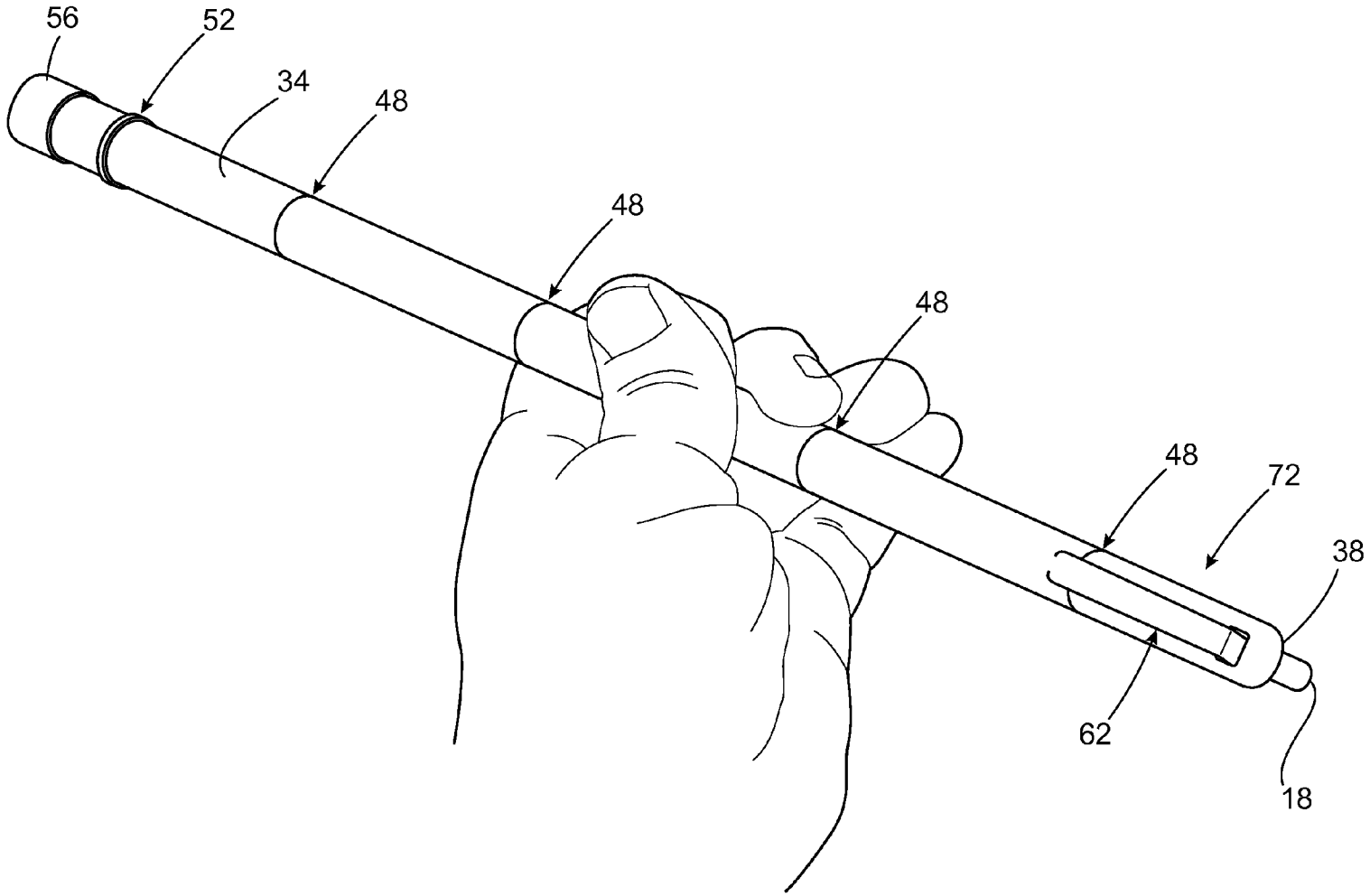
FIG. 2 is an illustration of an advantageous embodiment of the apparatus held in a user's hand.
Figure 7:
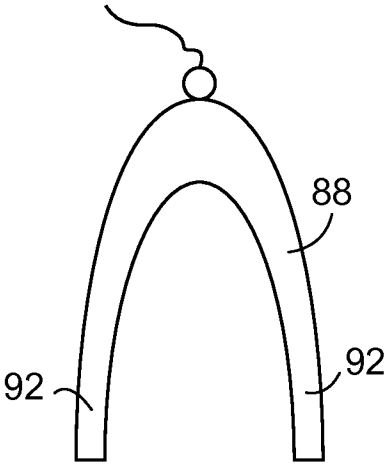
FIG. 7 is a view of a retention device clip used with the apparatus.

In a further embodiment of the apparatus the inner diameter dimension adjacent the housing distal end is enlarged so that the distal end of one housing can be assembled over the proximal end of a second housing. Internal screw threading represented by dashed lines 86 in FIG. 3 is provided in the interior surface of the one housing at the housing distal end. The internal screw threading 86 is dimensioned to mate with the external screw threading that holds the closure device to the housing proximal end. The internal screw threading 86 at the distal end of the one housing is screw threaded on the external screw threading at the proximal end of the second housing to connect the two housings end to end. This would allow the connected housings to contain twice as many cleco type fasteners as one housing alone.

Figure 6:
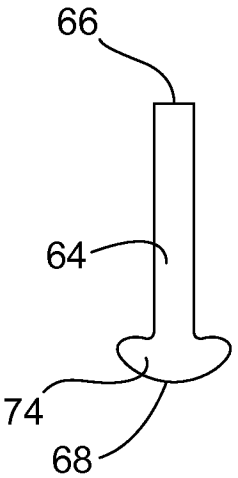
FIG. 6 is an enlarged view of one spring strip of the apparatus.

A retainer clip 88 such as that shown in FIG. 6 would be provided with this further embodiment of the apparatus. The retainer clip 88 has a pair of tines 92 that are dimensioned to fit over the exterior of the second housing 34 and beneath the lengths of the retention strips 64. Inserting the clip on the second housing would cause the retention device projections 74 to be retracted into the adjacent holes 72 in the second housing where the projections would not engage with the flanges 16 of fasteners contained in the second housing. This would allow the plurality of cleco type fasteners 12 contained in the two attached housings to pass freely from the one housing into the second housing.

The apparatus 32 and its method of use provide for the secure containing and transporting of a plurality of same size cleco type fasteners and the orderly dispensing of the fasteners. The apparatus and its method of use also overcome the inventory and FOD control problems of prior apparatus and methods used for containing, transporting and using cleco type fasteners.

As various modifications could be made in the constructions of the apparatus herein described and illustrated and its method of use without departing from the scope of the invention, it is intended that all matter contained in the foregoing description or shown in the accompanying drawings shall be interpreted as illustrative rather than limiting. Thus, the breadth and scope of the present invention should not be limited by any of the above described exemplary embodiments, but should be defined only in accordance with the following claims appended hereto and their equivalents.

The invention claimed is:

1. A method of containing, transporting, dispensing and keeping an inventory of a plurality of cleco type fasteners, having annular flanges, and of avoiding foreign object damage resulting from a cleco type fastener being left behind at a structure undergoing a manufacturing procedure, the method comprising:

inserting the plurality of cleco type fasteners into an interior bore of a housing, the housing having a length, a proximal end, and a distal end;

defining the interior bore of the housing by a cylindrical interior surface of the housing that extends around the interior bore and through the length of the housing between the proximal end and the distal end of the housing, providing the cylindrical interior surface with an interior diameter dimension that is larger than cross-section diameter dimensions of the plurality of cleco type fasteners;

providing a pair of holes through opposite sides of the housing adjacent the distal end of the housing;

removably attaching a closure device to the housing proximal end;

securing a pair of strips of spring steel having a body and opposite proximal and distal ends to an exterior surface of the housing on opposite sides of the housing so that lengths of the strips extending along the length of the housing, extending projections on the distal ends of the strips through the holes at the opposite sides of the housing, the distal ends of the strips comprising distal end tips having a semicircular profile ends with a cross section profile large than a cross section profile of the body of the strips, so that the projections extending a distance into the interior bore of the housing and engage against an annular flange of a first one of the plurality of cleco type fasteners in the interior bore of the housing and retain the first one of the plurality of cleco type fasteners in the interior bore of the housing with a portion of the first one of the plurality of cleco type fasteners extending from the distal end of the housing to an exterior of the housing;

providing the lengths of the strips with resiliency and securing the proximal ends of the strips to the exterior surface of the housing;

transporting the plurality of cleco type fasteners in the housing to the structure undergoing the manufacturing procedure;

deflecting the lengths of the strips and the distal ends of the strips outwardly away from each other by manually grasping and pulling the portion of the first one of the plurality of cleco type fasteners, extending from the housing distal end and causing the annular flange on the first one of the plurality of cleco type fasteners to pass between the projections of the strips and out of engagement with the projections of the strips while removing the first one of the plurality of cleco type fasteners out of the housing, with the resiliency of the strips then causing the projections to return to at rest positions in the interior bore of the housing where the projections engage against an annular flange of a remaining cleco type fastener in the interior bore of the housing and retain the remaining cleco type fastener in the interior bore of the housing with a portion of the remaining cleco type fastener extending from the distal end of the housing to the exterior of the housing;

removing additional cleco type fasteners of the remaining cleco type fasteners from the interior bore of the housing as needed for the manufacturing procedure;

returning removed cleco type fasteners to the interior bore of the housing at a conclusion of the manufacturing procedure;

taking an inventory of cleco type fasteners, returned to the interior bore of the housing, by viewing the interior bore of the housing and counting the cleco type fasteners, returned to the interior bore, and thereby avoiding foreign object damage from a cleco type fastener being left behind at the structure.

2. The method of claim 1, further comprising:

viewing the interior bore of the housing from the exterior of the housing.

3. The method of claim 1, further comprising:

viewing the interior bore of the housing from the exterior of the housing; and, viewing the plurality of cleco type fasteners contained in the interior bore of the housing through a slot in the housing.

4. The method of claim 1, further comprising:

taking the inventory of the cleco type fasteners, returned to the interior bore of the housing, by viewing a plurality of marks on the housing that are spatially arranged along the length of the housing from the distal end of the housing and correspond with positions of the plurality of cleco type fasteners in the interior bore of the housing from a forward most cleco type fastener of the plurality of cleco type fasteners retained by the pair of projections.

5. The method of claim 1, further comprising:

determining a size of the plurality of cleco type fasteners in the housing by viewing a size indicator on the housing.

6. The method of claim 1, further comprising:

taking the inventory of the cleco type fasteners, returned to the interior bore of the housing, by viewing a plurality of marks on the housing that are spatially arranged along the length of the housing with a distance dimension between adjacent marks of the plurality of marks being substantially equal to a length dimension of a cleco type fastener.

7. The method of claim 1, further comprising:

inserting a plurality of same size cleco type fasteners in a same orientation of each cleco type fastener of the plurality of same size cleco type fasteners into the interior bore of the housing.

8. The method of claim 1, further comprising:

releasably retaining the first one of the plurality of cleco type fasteners in the interior bore of the housing with the portion of the first one of the plurality of cleco type fasteners extending from the distal end of the housing to the exterior of the housing by engaging the pair of projections against the annular flange of the first one of the plurality of cleco type fasteners with a sufficient force that prevents the first one of the plurality of cleco type fasteners from separating from the distal end of the housing in response to a force of a combined weight of the plurality of cleco type fasteners inserted into the interior bore of the housing but allows the first one of the plurality of cleco type fasteners to be separated from the distal end of the housing in response to the first one of the plurality of cleco type fasteners being manually grasped, pulled and separated from the distal end of the housing.

9. A method of containing, transporting, dispensing and keeping inventory of a plurality of same size cleco type fasteners having annular flanges, and of avoiding foreign object damage resulting from a cleco type fastener being left behind at a structure undergoing a manufacturing procedure, the method comprising:

inserting the plurality of same size cleco type fasteners into an interior bore of a housing, the housing having a length, a proximal end, and a distal end, the interior bore having a circular proximal opening at the housing proximal end and a circular distal opening at the housing distal end, defining the interior bore of the housing by a cylindrical interior surface of the housing that extends around the interior bore and through the length of the housing between the circular proximal opening at the proximal end of the housing and the circular distal opening at the distal end of the housing, providing the cylindrical interior surface with an interior diameter dimension that is larger than cross-section diameter dimensions of the annular flanges of the plurality of cleco type fasteners enabling the plurality of cleco type fasteners to be contained in the interior bore with the plurality of cleco type fasteners being arranged end to end and enabling the plurality of cleco type fasteners to slide through the interior bore;

providing a pair of holes through the opposite sides of the housing adjacent the distal end of the housing;

removably attaching a closure device to the proximal end of the housing and closing the circular proximal opening;

securing a pair of strips of spring steel having a body and opposite proximal and distal ends to an exterior surface of the housing by securing the proximal ends of the strips to the exterior surface of the housing on opposite sides of the housing so that lengths of the strips extend along the housing length and with projections formed at the distal ends of the strips extending through the holes through the housing, the distal ends of the strips comprising distal end tips having a semicircular profile ends with a cross section profile large than a cross section profile of the body of the strips, so that the projections extend a distance into the interior bore of the housing and engage against an annular flange of the first one of the plurality of cleco type fasteners in the interior bore of the housing;

retaining the first one of the plurality of cleco type fasteners in the interior bore of the housing with a portion of the first one of the plurality of cleco type fasteners extending from the distal end of the housing to an exterior of the housing by engaging the pair of projections against the annular flange of the first one of the plurality of cleco type fasteners;

transporting the plurality of cleco type fasteners in the housing to the structure undergoing the manufacturing procedure;

resiliently deflecting the lengths of the pair of strips and the pair of projections outwardly away from each other by manually grasping and pulling the portion of the first one of the plurality of cleco type fasteners extending from the distal end of the housing and pulling the annular flange of the first one of the plurality of cleco type fasteners to pass between the pair of projections and out of engagement with the pair of projections while removing the first one of the plurality of cleco type fasteners out of the housing;

returning the pair of projections to at rest positions in the interior bore of the housing by resiliency of the pair of strips where the pair of projections engage against an annular flange of a remaining cleco type fastener of the plurality of cleco type fasteners in the interior bore of the housing and retain the remaining cleco type fastener of the plurality of cleco type fasteners in the interior bore of the housing with a portion of the remaining cleco type fastener of the plurality of cleco type fasteners extending from the distal end of the housing to the exterior of the housing;

removing additional cleco type fasteners of the remaining cleco type fasteners from the interior bore of the housing as needed for the manufacturing procedure;

returning removed cleco type fasteners to the interior bore of the housing at a conclusion of the manufacturing procedure;

taking an inventory of cleco type fasteners returned to the interior bore of the housing by viewing the interior bore of the housing; and, counting the cleco type fasteners, returned to the interior bore, and thereby avoiding foreign object damage from a cleco type fastener being left behind at the structure.

10. The method of claim 9, further comprising:

viewing the plurality of cleco type fasteners in the interior bore of the housing from the exterior of the housing.

11. The method of claim 9, further comprising;

viewing the plurality of cleco type fasteners contained in the interior bore of the housing from the exterior of the housing; and, viewing the plurality of cleco type fasteners contained in the interior bore of the housing through a slot in the housing.

12. The method of claim 9, further comprising:

taking the inventory of the cleco type fasteners returned to the interior bore of the housing by viewing a plurality of marks on the housing that are spatially arranged along the length of the housing with a distance dimension between adjacent marks of the plurality of marks being substantially equal to a length dimension of a cleco type fastener.

13. The method of claim 9, further comprising:

taking the inventory of the cleco type fasteners returned to the interior bore of the housing by viewing a plurality of marks on the housing that are substantially equally spaced along the length of the housing and correspond with positions of the plurality of cleco type fasteners contained in the interior bore of the housing that are arranged end to end from a forward most cleco type fastener retained in the interior bore by the pair of projections.

14. The method of claim 9, further comprising:

determining a size of the plurality of cleco type fasteners contained in the housing interior bore by viewing a size indicator on the housing.

15. A method of containing, transporting, dispensing and keeping an inventory of a plurality of cleco type fasteners having annular flanges, and of avoiding foreign object damage resulting from a cleco type fastener being left behind at a structure undergoing a manufacturing procedure, the method comprising:

inserting a plurality of cleco type fasteners into an interior bore of a housing having a length with opposite proximal and distal ends with each cleco type fastener of the plurality of cleco type fasteners being inserted into the interior bore at the housing proximal end and moving through the interior bore toward the housing distal end, defining the interior bore of the housing by a cylindrical interior surface of the housing that extends around the interior bore and through the length of the housing between the proximal end of the housing and the distal end of the housing, providing the cylindrical interior surface with an interior diameter dimension that is larger than cross-section diameter dimensions of the plurality of cleco type fasteners enabling the plurality of cleco type fasteners to slide through the interior bore of the housing;

providing a pair of holes through opposite sides of the housing adjacent the distal end of the housing;

securing a pair of strips of spring steel having a body and opposite proximal and distal ends to an exterior surface of the housing on opposite sides of the housing so that lengths of the strips extend along the length of the housing, extending projections on the distal ends of the strips through the holes through the opposite sides of the housing, the distal ends of the strips comprising distal end tips having a semicircular profile ends with a cross section profile large than a cross section profile of the body of the strips, so that the projections extending a distance into the interior bore of the housing and engage against an annular flange of a first one of the plurality of cleco type fasteners inserted into the interior bore of the housing and retain the first one of the plurality of cleco type fasteners in the interior bore of the housing with a portion of the first one of the plurality of cleco type fasteners extending from the distal end of the housing to an exterior of the housing;

providing the lengths of the strips with resiliency and securing the proximal ends of the strips to the exterior surface of the housing enabling the distal ends of the strips and the projections on the strips to be resiliently deflected away from each other and resiliently return back toward each other, retaining the first one of the plurality of cleco type fasteners inserted into the interior bore at the housing distal end with a portion of the first one of the plurality of cleco type fasteners protruding from the housing distal end where the portion of the first one of the plurality of cleco type fasteners can be manually grasped, pulled and separated from the housing distal end;

transporting the plurality of cleco type fasteners in the housing to the structure undergoing the manufacturing procedure;

deflecting the lengths of the strips and the distal ends of the strips outwardly away from each other by manually grasping and pulling the portion of the first one of the plurality of cleco type fasteners extending from the housing distal end and causing the annular flange on the first one of the plurality of cleco type fasteners to pass between the projections formed on the distal ends of the strips and out of engagement with the projections while removing the first one of the plurality of cleco type fasteners out of the housing with the resiliency of the strips then causing the projections to return to at rest positions in the interior bore where the projections engage against an annular flange of a remaining cleco type fastener in the interior bore of the housing and retain the remaining cleco type fastener in the interior bore of the housing with a portion of the remaining cleco type fastener extending from the distal end of the housing to the exterior of the housing;

removing additional cleco type fasteners of the remaining cleco type fasteners from the interior bore of the housing as needed for the manufacturing procedure;

returning removed cleco type fasteners to the interior bore of the housing at a conclusion of the manufacturing procedure;

taking an inventory of cleco type fasteners returned to the interior bore of the housing by viewing the interior bore of the housing and counting the cleco type fasteners returned to the interior bore and thereby avoiding foreign object damage from a cleco type fastener being left behind at the structure.

16. The method of claim 15, further comprising:

retaining the forward most cleco type fastener at the housing distal end so that the forward most cleco type fastener will not separate from the housing distal end until manually grasped, pulled and separated from the housing distal end.

17. The method of claim 15, further comprising:

retaining the forward most cleco type fastener at the housing distal end with a sufficient force that prevents the forward most cleco type fastener from separating from the housing distal end in response to a force of a combined weight of the plurality of cleco type fasteners inserted into the interior bore but allows the forward most cleco type fastener to be separate from the housing distal end in response to the forward most cleco type fastener being manually grasped, pulled and separated from the housing distal end.

18. The method of claim 15, further comprising:

manually closing the interior bore at the housing proximal end and preventing the plurality of cleco type fasteners inserted into the interior bore from being removed from the interior bore at the housing proximal end.

19. The method of claim 15, further comprising:

inserting a plurality of same size cleco type fasteners in a same orientation of each cleco type fasteners of the plurality of cleco type fasteners into the interior bore of the housing.

* * * * *